US006431527B1

(12) United States Patent
Suzuki et al.

(10) Patent No.: US 6,431,527 B1
(45) Date of Patent: Aug. 13, 2002

(54) ROTARY THROTTLE VALVE CARBURETOR

(75) Inventors: Masao Suzuki, Miyagi Pref.; Tamio Aihara, Miyagi, both of (JP)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/705,235

(22) Filed: Nov. 2, 2000

(30) Foreign Application Priority Data

Nov. 15, 1999 (JP) ..... 11-323875

(51) Int. Cl.[7] ..... F02M 9/06; F02M 9/08

(52) U.S. Cl. ..... 261/44.3; 261/44.6; 261/44.8; 261/45; 261/63; 261/65; 261/DIG. 55; 261/DIG. 83

(58) Field of Search ..... 261/44.3, 44.4, 261/44.6–44.8, 45–47, 63, 65, 64.1, DIG. 55, DIG. 83, DIG. 39

(56) References Cited

U.S. PATENT DOCUMENTS 1,412,137 A * 4/1922 Redmond ..... 261/44.7 X
2,809,623 A * 10/1957 Hall ..... 261/65 X
3,353,801 A * 11/1967 Sarto ..... 261/65 X
3,684,257 A * 8/1972 Lawrence ..... 261/44.4 X
3,867,487 A * 2/1975 Matsumoto ..... 261/65 X
4,108,952 A * 8/1978 Iwao ..... 261/44.3
4,268,462 A * 5/1981 Ota et al. ..... 261/44.6 X
4,347,195 A * 8/1982 Ogawa ..... 261/44.4 X
4,505,250 A * 3/1985 Hada et al. ..... 261/44.3 X
4,519,957 A * 5/1985 Ito et al. ..... 261/DIG. 39
4,562,012 A * 12/1985 Teramura et al. ..... 261/44.4
4,620,951 A * 11/1986 Makino et al. ..... 261/44.3
5,599,484 A * 2/1997 Tobinai ..... 261/44.8 X

FOREIGN PATENT DOCUMENTS

GB 663965 * 1/1952 ..... 261/44.3

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A rotary throttle valve carburetor for a two cycle engine reroutes a portion of intake air and introduces the air around the circumference of a fuel feed tube. A rotary throttle, rotatable and vertically moveable, fits into a cylindrical chamber intersecting an air intake channel through a carburetor body. A needle supported by the rotary throttle fits into the fuel feed tube which extends from a fuel metering chamber within the carburetor body into a throttling bore extending laterally through the rotary throttle. An intake portion of the air intake channel expands conically toward an upstream side. An air guide tube is aligned co-axially and radially outward from a fuel feed tube forming an air passageway there between. The intake air portion flows through the air passage from the intake portion of the air intake channel and into a bottom space of the cylindrical chamber beneath the rotary throttle. From the bottom space, the air flows through the passageway transversely into a fuel stream emitted from a fuel jet orifice of the fuel feed tube. Excessive fuel flow is thereby controlled and fuel vaporization is promoted, resulting in improved fuel burn efficiency and a reduction of exhaust emissions.

12 Claims, 2 Drawing Sheets

ROTARY THROTTLE VALVE CARBURETOR

Related Application

Applicants claim priority of Japanese patent application, Ser. No. 11-323875, filed Nov. 15, 1999.

FIELD OF THE INVENTION

This invention relates to a carburetor, and more particularly to a rotary throttle valve carburetor for a two cycle engine.

BACKGROUND OF THE INVENTION

A fuel and air mixture is fed into a crankcase of an operating two cycle engine from a conventional rotary throttle valve carburetor via negative pressure. Within the carburetor, fuel flows from a fuel metering chamber into an air intake channel. Within the channel, the fuel mixes with air and is then drawn into the crankcase. From the crankcase, the fuel and air mixture flows into a combustion chamber and is burned. Relative to other combustion engines, the combustion process of conventional two cycle engines is inefficient. The fuel to air mixture does not completely burn and the resultant air pollutants from the exhaust are relatively high. To alleviate some of the air pollutant concerns, the industry is trending toward a leaner fuel to air mixture to achieve a cleaner burn. The dynamics or isolated transients of the mixing and burning process during acceleration and deceleration of the two cycle engine offer a variety of design challenges.

One such transient occurs during deceleration of the two cycle engine when negative pressure within the air intake channel of the rotary throttle valve carburetor increases causing excessive fuel to be drawn through a fuel feed tube and mix with air within the intake channel. When this occurs, the subsequent fuel and air mixture is too rich and the combustion process is not capable of burning all the fuel. The exhaust is therefore affected and the air pollutants rise.

Because the fuel in the fuel metering chamber is directly drawn into the throttling bore of the rotary throttle from a fuel jet orifice through the fuel feed tube, the mixing of fuel and air, i.e. vaporization, is incomplete. Accordingly, it is difficult to attain lean-mixture combustion in the combustion chamber of a two cycle engine.

SUMMARY OF THE INVENTION

A rotary throttle valve carburetor for a two cycle engine has a rotary throttle disposed transversely through an air intake channel through a carburetor body. The rotary throttle rotates and moves vertically within a cylindrical chamber defined by the carburetor body. A throttling bore laterally extends through the rotary throttle and adjustably aligns longitudinally with the air intake channel. The rotary throttle supports a needle extending therefrom longitudinally into a fuel feed tube supported at one end by the carburetor body. The fuel feed tube provides a path for fuel flow from a fuel metering chamber.

An air passage defined by the carburetor body communicates between an intake portion of the air intake channel and a passageway which communicates with the throttling bore of the rotary throttle. The passageway is formed between an air guide tube and the fuel feed tube. Preferably, the rotary throttle supports the air guide tube which is concentric to the fuel feed tube. A bottom space communicates between the air passage and the passageway. An annular face of the carburetor body penetrated by the fuel feed tube and an under annular face of the rotary throttle axially define the bottom space. The air passage communicates with the bottom space through the annular face of the carburetor body. A fuel jet orifice extends laterally through the fuel feed tube thereby emitting fuel transversely into the passageway.

Objects, features and advantages of this invention include reducing air intake vacuum during deceleration transients of the two cycle engine to prevent excessive fuel draw, avoiding overly rich fuel to air mixture, increasing vaporization of the fuel within the throttling bore, and decreasing engine exhaust emissions.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
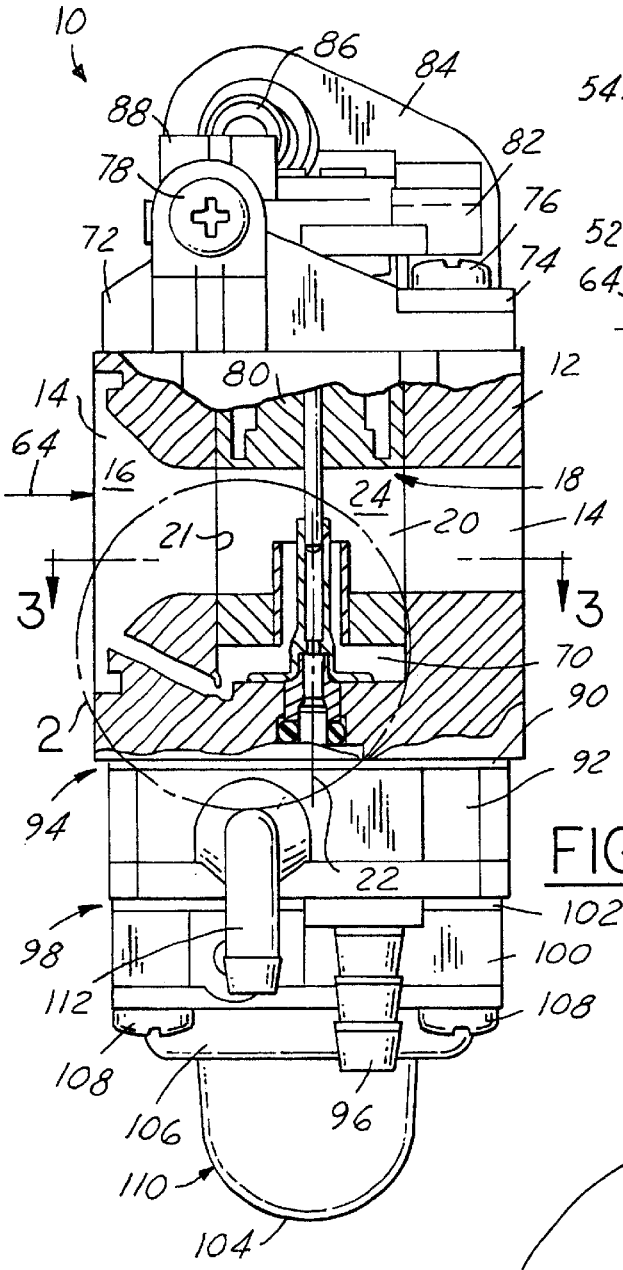
FIG. 1 is a side view with portions broken away and in cross-section of a rotary throttle valve carburetor for a two cycle engine according to the present invention.
Figure 3:
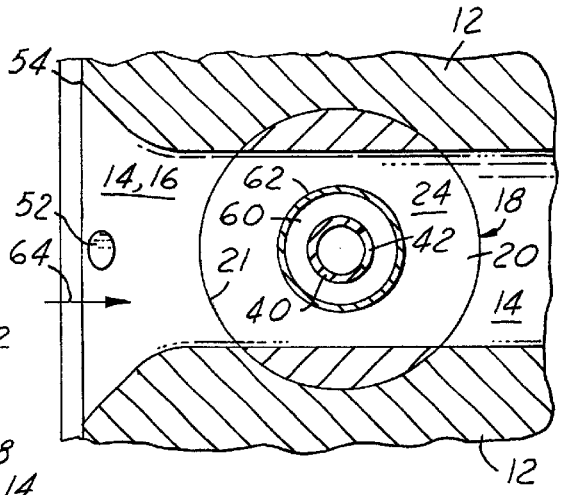
FIG. 3 is a partial cross-section view of the rotary throttle valve taken along line 3—3 in FIG. 1.
Figure 2:
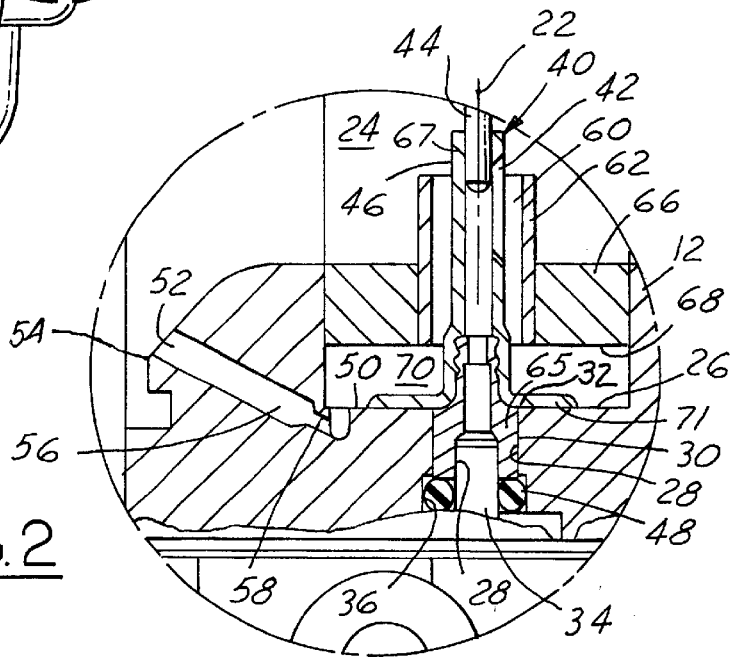
FIG. 2 is an enlarged cross-section view of the rotary throttle valve portion identified by reference circle 2 in FIG. 1.

Referring in more detail to the drawings, FIGS. 1–3 depict a rotary valve carburetor 10 in accordance with the present invention. The carburetor has a body 12 with a through air intake channel 14 which communicates with an air filter on an upstream side and a crankcase of a two cycle engine on the downstream side. The carburetor body 12 defines an intake portion 16 of the air intake channel 14 on the upstream side. The intake portion 16 flares radially outward in the upstream direction.

A rotary throttle 18 partially obstructs, or controls air passage through carburetor 10 by intersecting channel 14. Rotary throttle 18 rotatably seats and is operatively moveable vertically within a cylindrical chamber 20 defined by a circumferential face 21 of the carburetor body 12. Chamber 20 communicates with and extends transversely through the air intake channel 14. Rotary throttle 18 generally inserts into the chamber 20 from above and rotates in assembly about a centerline axis 22. A throttling bore 24 extends laterally through rotary throttle 18 and communicates operatively with the air intake channel 14. Throttling bore 24 is substantially perpendicular to the axis 22 and is aligned so that when the carburetor 10 is in the full open throttle position the throttling bore 24 is in fall communication with the air intake channel 14.

Defining the bottom portion of chamber 20 is an annular face 26 of the carburetor body 12. A mid surface 28 of the carburetor body 12 defines a mid bore 30 which communicates concentrically with the chamber 20 radially inward of the annular face 26 from beneath. The mid cylindrical surface 28 is congruent to an inner circumference or perimeter 32 of the annular face 26. Communicating concentrically with the mid bore 30 from beneath is a lower counterbore 34 defined by a lower cylindrical surface 36 of the carburetor body 12. The circumference of the lower counterbore 34 is slightly larger than the circumference of the mid bore 24. And the circumference of the chamber 20 is larger than the circumference of the lower counterbore 34.

A fuel feed tube 40 extending centrally upward into the throttling bore 24 on centerline axis 22 is secured rigidly to the mid cylindrical surface 28 of the mid bore 24. A fuel jet orifice or aperture 42 extends laterally through the wall of the fuel feed tube 40 and communicates with the throttling bore 24 of the rotary throttle 18. Fuel is drawn or travels from a fuel metering chamber, past a check valve (not shown), up the fuel feed tube 40, through the fuel jet orifice 42, and into the throttling bore 24. Controlling fuel flow through the fuel jet orifice 42 is an obstructing needle 44 slidably received with a close fit in the fuel feed tube 40 from above. Rotary throttle 18 supports needle 44 from above. As rotary throttle 18 rotates within chamber 20, it also moves vertically. Likewise, needle 44 also moves vertically within the fuel feed tube 40 thereby adjusting the opening size of the fuel jet orifice 42.

The carburetor body 12 defines an air passage 52 communicating with the intake portion 16 of the air intake channel 14 substantially near an outer perimeter 54 which defines the outward radial extremity of the flared surface defining the intake portion 16. Air passage 52 has a downstream end 56 narrowing through a restrictor 58 of the carburetor body 12. The downstream end 56 intercommunicates with a passageway 60 defined by an air guide tube 62 disposed substantially concentrically with and radially outward from the fuel feed tube 40. The air guide tube 62 aligns co-axially with the fuel feed tube 40 and extends substantially into the throttling bore 24.

During normal operation of the two cycle engine, negative pressure is brought about due to the intake air flowing in the direction of the arrow 64 within the air intake channel 14. Fuel from the metering fuel chamber flows, via the negative pressure, into the throttling bore 24 through the fuel feed tube 40 and the fuel jet orifice 42. Simultaneously, the intake air from the air passage 52 flows through the restrictor 58 and into the passageway 60. The air is mixed therein with the fuel emitting from the fuel jet orifice 42, whereby atomization or vaporization of the fuel is promoted. The atomized fuel mixes with the remaining intake air flowing through the air intake channel 14 and throttling bore 24. Consequently, combustion efficiency is improved, promoting a leaner engine operating mixture of fuel to air.

During sudden deceleration of the engine, the alignment of the air intake channel 14 with the throttling bore 24 is minimal. That is, the opening ratio of the throttling bore 24 relative to the air intake channel 14 is reduced. This minimal alignment would produce a strong negative pressure acting upon the fuel jet orifice 42 thereby causing an overly rich fuel to air mixture, if it were not for the intake air supplied through the air passage 52 and the passageway 60. The intake air moving through the passageway 60 and shrouding the fuel jet orifice 42 alleviates the otherwise strong negative pressures during deceleration. The air passage 52 and passageway 60 act as a bypass passage, whereby excessive fuel draw and combustion inefficiency created by sudden deceleration can be prevented. With the elimination of the high unwanted vacuum during deceleration and the improved fuel to air mixing, the inner circumference or diameter of the fuel feed tube 40 can be enlarged to permit greater fuel flow during acceleration or other operating periods of the two cycle engine. Increasing the inner circumference of the fuel feed tube 40, or the size of any orifice formed therein, will decrease the potential of foreign debris becoming lodged within the fuel feed tube 40.

A base tube portion 65 of the fuel feed tube 40 engages the mid cylindrical surface 28 within the mid bore 30. A smaller portion of the base tube portion 65 extends axially upward beyond the mid bore 30 and above the annular face 26 of the carburetor body 12. Disposed radially outward and telescopically engaging the smaller portion of the base tube portion 65 is an upper extension tube portion 67 of the fuel feed tube 40. An end flange portion 71 of the extension tube portion 67 secures rigidly to the annular face 26 thereby supporting the fuel feed tube 40 to the carburetor body 12. An o-ring 48 seats within the lower bore 34 and seals between mid bore 30 and base tube portion 65. O-ring 48 thereby prevents leakage of fuel between the mid cylindrical surface 28 of the mid bore 30 and an outer radial surface 46 of the base tube portion 65 or the fuel feed tube 40.

A lower portion 66 of the rotary throttle 18 has an under annular surface 68 substantially perpendicular to and coaxial with the centerline axis 22. The under annular surface 68 is positioned above and substantially parallel to the bottom annular surface 50. The under annular surface 68 and the bottom annular surface 50 axially define a donut-shaped bottom space 70 of the cylindrical chamber 20. The circumferential face 21 radially outwardly defines the bottom space 70, and the outer radial surface 46 of the fuel feed tube 40 radially inwardly defines the bottom space 70. Bottom space 70 interconnects or inter-communicates with the air passage 52 and the passageway 60. The air guide tube 62 rigidly engages and penetrates the lower portion 66 of the rotary throttle 18. Air guide tube 62 congruently extends upward from an inner perimeter of the under annular surface 68 and into the throttling bore 24.

In assembly of carburetor 10, a cap plate 72 and a metal reinforcement plate 74 close off the cylindrical chamber 20 with rotary throttle 18 received in the carburetor body 12. Plates 72, 74 secure to the carburetor body 12 by bolts 76. Rotation of the rotary throttle 18 is achieved by a throttle lever 82. Lever 82 secures substantially perpendicularly to an upper end of a shaft portion 80 of the rotary throttle 18 which extends through the cap plate 72. Rotation of the rotary throttle 18 is restricted by an idle adjustment screw 78 which threads through an upwardly projecting wall on the cap plate 72. Vertical movement of the rotary throttle 18, and therefore vertical movement of the needle 44 in the fuel feed tube 40, is achieved coincidentally to the rotational movement of the rotary throttle 18. A non-shown cam surface of a groove which changes its depth along a circumferential direction forms on a lower surface of the throttle lever 82. The cap plate 72 rigidly supports an upward extending follower (not shown) which makes slidable contact with the cam surface. The slope of the cam surface is such, that the rotary throttle 18 lifts upward with the needle 44 when the throttling bore 24 increasingly aligns to the air intake channel 14.

Remote actuation or rotation of the throttle lever 82 and therefore the rotary throttle 18 is conducted via a control cable. An outer tube of the remote control cable is fixed to a wall portion 84 by a metallic mount fitting 86. Wall portion 84 extends upward from the metallic reinforcement plate 74 and is a unitary part thereof. An inner wire of the remote control cable is connected to a swivel 88 supported rotatably by the throttle lever 82.

The throttle lever 18 is biased rotationally against a threaded end of the idle adjustment screw 78 by a return spring, not shown. When the throttle lever 82 is in contact with the idle adjustment screw 78, the opening ratio of the throttling bore 24 to the air intake channel 14 is set at an idle position. When the throttle lever 82 rotates about centerline axis 22 against the force or resilience of the return spring toward a full-open position, the opening ratio of the throttling bore 24 increases, the rotary throttle 18 and the needle 44 are pushed upward by the contact between the circumferential cam surface and the follower, and the opening ratio of the fuel jet orifice 42 increases. To open the throttle, an operator exerts a force through the control cable which radially winds the return spring as the rotary throttle opens. When the control cable is released, the wound return spring unwinds and the rotary throttle 18 automatically returns to an idle position.

The return spring is received within a circular spring groove 90 formed into the shaft portion 80 of the rotary throttle 18 from above. The return spring is capable of winding upon rotation of the rotary throttle 18 because one end of the return spring is engaged with the rotary throttle 18 and the other end is engaged with the cap plate 72.

With the rotary throttle fully open, not only is the return spring fully wound, but it is under axial tension. As the rotary throttle opens, or rotates away from the idle position, the contact of the follower with the circumferential cam surface of the throttle lever 82 causes the rotary throttle 18 to lift and the needle 44 to move outwardly from the fuel feed tube 40 against the axial resilience of the return spring. When the operator releases the control cable, the circumferential cam surface of the throttle lever 82 is biased against the follower by the axial tension of the return spring. The cam surface slides against the follower until the throttle lever 82 presses upon the idle adjustment screw 78 as a result of the wound or radial tension of the return spring.

A resilient or pulsation membrane 90 interconnects and seals between an intermediate wall 92 and a bottom end of the carburetor body 12. Furthermore, resilient membrane 90 is part of fuel pump 94 further comprising a pulsation pressure chamber and a pump chamber with the resilient membrane disposed communicatively there between. A suction check valve is disposed at an inlet side of the fuel pump 94 and a discharge check valve is disposed at an outlet side of the fuel pump. The fuel pump 94 draws fuel from a fuel tank, not shown, through an inlet tube 96 and into the pump chamber. From the pump chamber, the fuel flows through an inflow valve and into the fuel metering chamber. A constant pressure fuel supply mechanism 98 comprises a lower wall 100 disposed beneath the intermediate wall 92 with a resilient membrane 102 disposed sealably between them. An upward facing surface of the membrane 102 defines the constant pressure fuel chamber, and a downward facing surface of membrane 102 defines an atmospheric air chamber.

A suction pump 110 is formed on the lower end of the lower wall 100. It has, a resilient dome or chamber-wall 104 with its periphery attached to the lower end of the lower wall 100 by a circumferential clamp plate 106 and bolts 108. The fuel or suction pump 110 has a suction valve at an inlet side and a discharge valve at an outlet side formed or defined by the resilient membrane 102. By repeatedly manually alternately pushing and releasing the resilient dome 104 of the suction pump 110 before starting the two cycle engine, the vaporized fuel and/or air in the fuel metering chamber is drawn into the resilient chamber-wall 104 and returned to the fuel tank through a discharge tube 112, and, liquid fuel is supplied from the fuel tank to the fuel metering chamber through the fuel pump 94.

Figure 4:
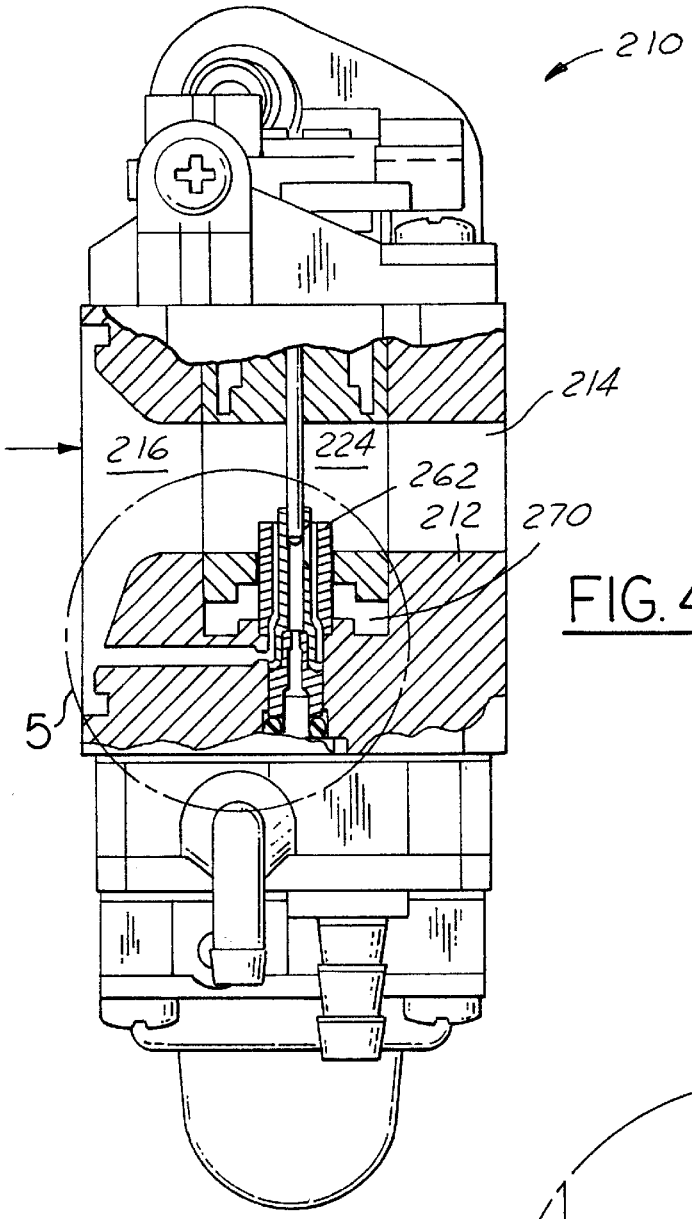
FIG. 4 is a side view with portions broken away and in cross-section of a second embodiment of the rotary throttle valve.
Figure 5:
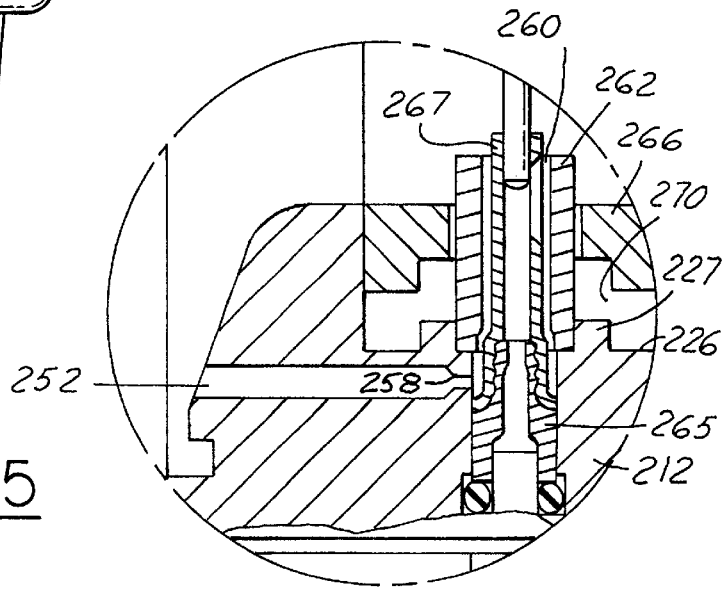
FIG. 5 is an enlarged cross-section view of the rotary throttle valve portion identified by reference circle 5 in FIG. 4.

Referring to FIGS. 4 and 5, a second embodiment of the present invention is shown. The air guide tube 262 engages rigidly to the annular face 226 of the carburetor body 212. Preferably, the annular face 226 concentrically defines an upward or axially extending collar 227. A radial inward surface of the collar 227 engages a radial outward surface of the air guide tube 262. The lower portion 266 of the rotary throttle rotates and substantially seals about the air guide tube 262. The air passage 252 with restrictor 258 directly communicates with the passageway 262, and the bottom space 270 is generally isolated from any air intake flow.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention as defined by the following claims.

We claim:

1. A rotary throttle valve carburetor comprising:

a carburetor body having an air intake channel, a cylindrical chamber, and an air passage, the air intake channel extending through the carburetor body, the air intake channel having an intake portion disposed upstream, the cylindrical chamber communicating laterally through the air intake channel downstream of the intake portion, and the air passage communicating between the intake portion and the cylindrical chamber;

a rotary throttle disposed rotatably and vertically moveably within the cylindrical chamber, the rotary throttle having a throttling bore extended laterally through the rotary throttle and aligned communicably with the air intake channel;

an air guide tube disposed within the cylindrical chamber and extending transversely into the throttling bore;

a fuel feed tube disposed radially inward of the air guide tube and concentrically to the rotary throttle, the fuel feed tube engaged at one end to the carburetor body and extending transversely into the throttling bore; and a passageway defined radially between the air guide tube and the fuel feed tube, the air passage communicating with the passageway, and the passageway communicating with the throttling bore.

2. The rotary throttle valve carburetor according to claim 1 comprising a needle engaged concentrically with the rotary throttle and extending transversely through the throttling bore and longitudinally into the fuel feed tube.

3. The rotary throttle valve carburetor according to claim 2 wherein the fuel feed tube has a fuel jet orifice communicating with the passageway.

4. The rotary throttle valve carburetor according to claim 3 wherein the air guide tube is engaged rigidly with a lower portion of the rotary throttle.

5. The rotary throttle valve carburetor according to claim 4 wherein the cylindrical chamber has a bottom space defined axially by an under annular face of the lower portion and a face of the carburetor body, the under annular face parallel to the face of the carburetor body, and the bottom space communicating between the air passage and the passageway.

6. The rotary throttle valve carburetor according to claim 5 wherein the carburetor body defines a restrictor adjacent a downstream end of the air passage.

7. The rotary throttle valve carburetor according to claim 6 wherein the downstream end of the air passage communicates with the bottom space through the face of the carburetor body.

8. The rotary throttle valve carburetor according to claim 7 wherein the face of the carburetor body is annular and concentric to the under annular face of the lower portion.

9. The rotary throttle valve carburetor according to claim 8 wherein the air guide tube is concentric to the fuel feed tube.

10. The rotary throttle valve carburetor according to claim 3 wherein the carburetor body has a mid surface and an annular face, the mid surface defines a mid bore communicating concentrically with the cylindrical chamber, the fuel feed tube is engaged circumferentially to the mid surface and extends through the annular face, and the air guide tube is engaged with the annular face.

11. The rotary throttle valve carburetor according to claim 10 wherein the carburetor body has a restrictor adjacent a downstream end of the air passage, and the downstream end communicates with the passageway through the mid surface.

12. The rotary throttle valve carburetor according to claim 11 wherein the annular face of the carburetor body defines a collar engaged with an outer radial surface of the fuel feed tube.

* * * * *